US010264830B2

(12) United States Patent
Ichigaya

(10) Patent No.: US 10,264,830 B2
(45) Date of Patent: Apr. 23, 2019

(54) AIR CONDITIONING CLOTHING

(71) Applicant: SFT Laboratory Co., Ltd., Tokyo (JP)

(72) Inventor: Hiroshi Ichigaya, Tokyo (JP)

(73) Assignee: SFT LABORATORY CO., LTD., Tokyo (JP)

( * ) Notice: Subject to any disclaimer, the term of this patent is extended or adjusted under 35 U.S.C. 154(b) by 262 days.

(21) Appl. No.: 15/127,727

(22) PCT Filed: Mar. 27, 2014

(86) PCT No.: PCT/JP2014/058871
§ 371 (c)(1),
(2) Date: Sep. 20, 2016

(87) PCT Pub. No.: WO2015/145666
PCT Pub. Date: Oct. 1, 2015

(65) Prior Publication Data

US 2017/0135419 A1 May 18, 2017

(51) Int. Cl.
*A41D 13/002* (2006.01)
*A41D 13/005* (2006.01)
*A41D 1/00* (2018.01)

(52) U.S. Cl.
CPC ..... *A41D 13/0025* (2013.01); *A41D 1/002* (2013.01); *A41D 13/0053* (2013.01)

(58) Field of Classification Search
CPC ..... A41D 13/0025; A41D 13/0053; A41D 27/10; A41D 1/002; A41D 1/02;
(Continued)

(56) References Cited

U.S. PATENT DOCUMENTS 1,302,038 A * 4/1919 Hayes ..... A41D 13/08 2/170
2,826,758 A * 3/1958 Kahn ..... A41D 13/0025 2/81
(Continued)

FOREIGN PATENT DOCUMENTS

JP 10-513233 A 12/1998
JP 11-323626 A 11/1999
(Continued)

OTHER PUBLICATIONS

English language machine translation of JP 2006-132040 Ichigaya (pub Nov. 2006); 20 pages.*
(Continued)

*Primary Examiner* — Amy Vanatta
(74) *Attorney, Agent, or Firm* — Crowell & Moring LLP

(57) ABSTRACT

An air-conditioning clothing is disclosed. The clothing includes a cloth portion covering an upper part and an arm portion of the body and guiding air in a space between the cloth portion and the body or an underwear along a surface of the body or the underwear. An air blower takes in air from outside and forcedly generates a flow of the air in the space. An air discharge is provided on a collar of the cloth portion and discharges the air to the outside. An air-leakage preventer is provided on a lower sleeve edge of the cloth portion and prevents leakage of the air flowing in the space to the outside through the lower sleeve edge. A sheet-shaped air discharger is provided at a predetermined portion in the vicinity of the lower sleeve edge of the cloth portion and discharges the air flowing in the space to the outside.

4 Claims, 5 Drawing Sheets

(58) Field of Classification Search
CPC ..... A41D 2400/20; A61F 2007/0018; A61F 2007/0063; A61F 2007/0064; A61F 2007/0029; A61F 2007/0022; A61F 2007/0023; A61F 2007/0024; A41B 7/00; A41B 7/06; A41B 7/12; F25D 2400/26
USPC ..... 62/259.3; 2/DIG. 1, 123
See application file for complete search history.

(56) References Cited

U.S. PATENT DOCUMENTS 3,113,320 A * 12/1963 Cherowbrier ..... A62B 17/006 2/81
3,525,334 A * 8/1970 Scott ..... A41D 13/0005 128/201.25
3,610,251 A * 10/1971 Sanderson ..... A41D 13/0025 2/69.5
4,389,734 A * 6/1983 Franz ..... A41D 13/1227 2/114
5,014,355 A * 5/1991 Vollenweider, II ..... A41D 13/0025 128/201.13
5,088,115 A * 2/1992 Napolitano ..... A41D 13/0025 2/69
5,105,477 A * 4/1992 Golde ..... A41D 27/10 2/108
5,255,390 A * 10/1993 Gross ..... A41D 13/0025 2/458
5,507,042 A 4/1996 Van der Slessen
5,704,064 A 1/1998 van der Sleesen
6,968,572 B1 * 11/2005 Johnson ..... A41D 13/08 2/16
2006/0080987 A1 * 4/2006 Ichigaya ..... A41D 13/0025 62/259.3
2009/0271917 A1 * 11/2009 Richardson ..... A41D 13/0025 2/458
2017/0156425 A1 * 6/2017 Jeong ..... A41D 27/02

FOREIGN PATENT DOCUMENTS

JP 2006-132040 A 5/2006
JP 2006-307354 A 11/2006
JP 2009-155773 A 7/2009
JP 3171957 U 11/2011
WO WO 2005/063065 A1 7/2005

OTHER PUBLICATIONS

English translation of previously submitted International Preliminary Report on Patentability (PCT/IPEA/409) issued in PCT Application No. PCT/JP2014/058871 dated Jan. 8, 2015 (C2) (Six (6) pages).
Japanese Office Action issued in Japanese counterpart application No. 2016-509753 dated Oct. 10, 2017 (Four (4) pages).
PCT/JP2014/058871, International Search Report (PCT/ISA/210) dated Jun. 24, 2014, with partial English translation, enclosing Written Opinion of the International Searching Authority (PCT/ISA/237) (Ten (10) pages).
International Preliminary Report on Patentability (PCT/IPEA/409) issued in PCT Application No. PCT/JP2014/058871 dated Jan. 8, 2015 (Four (4) pages).

* cited by examiner

PRIOR ART

AIR CONDITIONING CLOTHING

TECHNICAL FIELD

The present invention relates to an air-conditioning clothing for cooling a body by generating a flow of air substantially in parallel with a surface of the body or an underwear.

BACKGROUND ART

Recently, an air-conditioning clothing for cooling the body has been put into practice and is rapidly spreading. FIG. 5 is a schematic front view of a prior-art air-conditioning clothing. This air-conditioning clothing includes a cloth portion 10 sewn from a material with small ventilation and two fans 30 and 30 mounted on a lower part of side parts of the cloth portion 10. When the fans 30 are operated, a large quantity of air is taken into the cloth portion 10 from the fans 30. The taken-in air flows upward along the surface of the body or the underwear in a space between the cloth portion 10 and the body or the underwear and is discharged through around a collar or a lower sleeve edge 11 to an outside, for example. The air evaporates sweat from the body while flowing through the space between the cloth portion 10 and the body or the underwear, and the body is cooled by evaporation heat in the evaporation (see Patent document 1, for example). The air-conditioning clothing is a product for handling substantial hotness in its principle, and realization of the air-conditioning clothing that can be used when many works are performed is in high demand.

RELATED ART DOCUMENTS

Patent Documents

Patent document 1: Re-publication of PCT International Publication No. WO2005/063065

DISCLOSURE OF THE INVENTION

Problems to be Solved by the Invention

In the prior-art air-conditioning clothing, the lower sleeve edge 11 of the cloth portion 10 is open, and the lower sleeve edge 11 constitutes one of air discharge portions for discharging the air to the outside. As a result, since the air flows also through the space between an arm portion of the cloth portion 10 and the body or the underwear, not only a trunk but also the arm can be cooled. Moreover, in his case, a large quantity of the air is ejected from the lower sleeve edge 11 toward the fingertip. However, depending on work contents, ejection of the large quantity of air from the lower sleeve edge 11 toward the fingertip is not desirable in some cases. If the prior-art air-conditioning clothing is used when a welding work is performed, for example, a flame of the welding is disturbed by the air ejected from the lower sleeve edge 11 toward the fingertip. Moreover, if the prior-art air-conditioning clothing is used when documents or banknotes are handled, the documents and the like might be made to fly away by wind ejected from the lower sleeve edge 11. If the prior-art air-conditioning clothing is used when a work handling food products such as a food processing work or the like is performed, body hair and the like can fall on the food products by the wind ejected from the lower sleeve edge 11 toward the food products and be mixed with the food products. On the other hand, depending on an application of the air-conditioning clothing, its performances cannot be exerted sufficiently in some cases. In the case of a rainwear, for example, the lower sleeve edge is brought into close contact with a wrist so that the rainwater adhering to a hand does not enter inside from the lower sleeve edge when the hand is raised. Thus, if the air-conditioning clothing is used as the rainwear, the lower sleeve edge 11 needs to be brought into close contact with the wrist. Therefore, in this case, since the air does not flow any longer through the space between the arm portion of the cloth portion 10 and the body or the underwear, the arm cannot be cooled and the performances as the air-conditioning clothing are lost. With the prior-art air-conditioning clothing having the lower sleeve edge 11 open as above, there are many kinds of works hindered during the use, and there is a problem when such air-conditioning clothing is used for the welding work, a desk work, the food processing works, the rainwear and the like.

The present invention was made in view of the aforementioned circumstances and has an object to provide the air-conditioning clothing constituted so that the air is not ejected from the lower sleeve edge to the fingertip so as not to lose the body cooling performances.

Means of Solving the Problems

An air-conditioning clothing according to the present invention in order to achieve the aforementioned object includes a cloth portion covering at least an upper part and an arm portion of the body and guiding air in a space between the cloth portion and the body or an underwear along a surface of the body or the underwear, one or a plurality of air blowing means for taking in the air from an outside and for forcedly generating a flow of the air in the space between the cloth portion and the body or the underwear, power supply means for supplying power to the air blowing means, air discharge means for collar provided on a collar of the cloth portion and discharging the air flowing in the space between the cloth portion and the body or the underwear to the outside, air-leakage preventing means for lower sleeve edge, provided on a lower sleeve edge of the cloth portion and preventing leakage of the air flowing in the space between the cloth portion and the body or the underwear to the outside through the lower sleeve edge, and sheet-shaped air discharge means for sleeve provided at a predetermined portion in the vicinity of the lower sleeve edge of the cloth portion and discharging the air flowing in the space between the cloth portion and the body or the underwear to the outside.

In the air-conditioning clothing according to the present invention, by providing the air-leakage preventing means for lower sleeve edge for preventing leakage of the air to the outside through the lower sleeve edge on the lower sleeve edge of the cloth portion and by providing the sheet-shaped air discharge means for sleeve for discharging the air to the outside at the predetermined portion in the vicinity of the lower sleeve edge of the cloth portion, the air is not ejected directly from the lower sleeve edge toward the fingertip. Thus, by using the air-conditioning clothing according to the present invention, the work susceptible to the wind such as the welding work, the desk work, the food processing work and the like, for example, can be performed favorably. Moreover, the air-conditioning clothing according to the present invention can be also used as a clothing requiring tightening the lower sleeve edge such as the rainwear and the like. Furthermore, by providing the air discharge means for sleeve in the vicinity of the lower sleeve edge of the cloth portion, the air taken into the cloth portion from the air blowing means flows also in the space between the arm portion of the cloth portion and the body or the underwear and thus, substantially the whole portion of the body covered by the air-conditioning clothing can be cooled, and the body cooling performances are not lost.

Moreover, in the air-conditioning clothing according to the present invention, air guiding means for guiding the air discharged from the air discharge means for sleeve may be provided on the sleeve of the cloth portion so that the air flows to a side opposite to the lower sleeve edge. As a result, a direction of a flow of the air discharged from the air discharge means for sleeve can be regulated, and the flowing of the air toward the fingertip can be reliably prevented.

Effects of the Invention

The air-conditioning clothing according to the present invention is constituted so that the body cooling performances are not lost and the air is not ejected from the lower sleeve edge toward the fingertip. Thus, by using the air-conditioning clothing according to the present invention, the work susceptible to the wind such as the welding work, the desk work, the food processing work and the like, for example, can be performed favorably. Moreover, the air-conditioning clothing according to the present invention can be used also as a clothing requiring tightening the lower sleeve edge such as a rainwear and the like.

MODE FOR CARRYING OUT THE INVENTION

Embodiments for putting the invention according to the present application into practice will be described below by referring to the attached drawings.

First Embodiment

Figure 1:
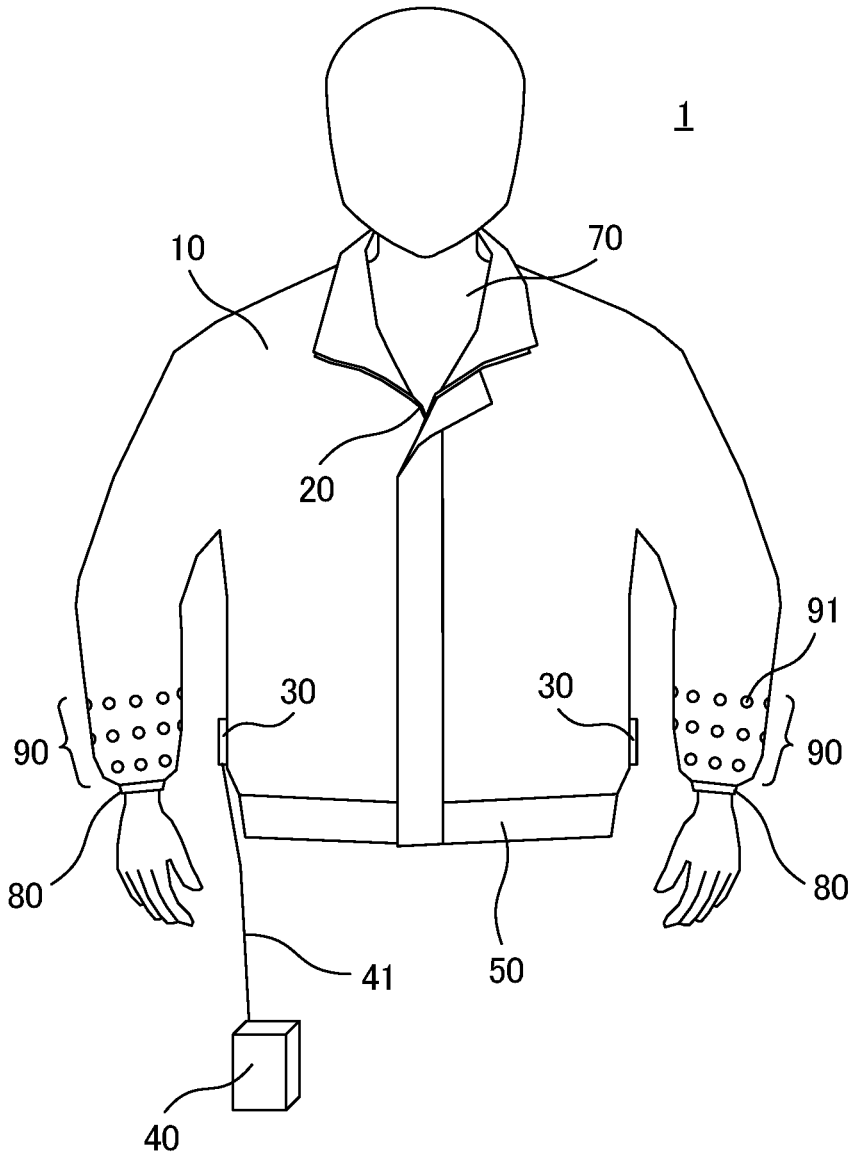
FIG. 1 is a schematic front view of an air-conditioning clothing which is a first embodiment of the present invention.

First, a first embodiment of the present invention will be described by referring to the drawings. FIG. 1 is a schematic front view of an air-conditioning clothing which is the first embodiment of the present invention.

As illustrated in FIG. 1, the air-conditioning clothing of the first embodiment includes a cloth portion 10, opening/closing means 20, two air blowing means (fans) 30 and 30, power supply means 40, air-leakage preventing means 50 for hem, an air discharge portion 70 for collar, air-leakage preventing means 80 for lower sleeve edge, and a sheet-shaped air discharge portion 90 for sleeve.

The cloth portion 10 covers at least an upper body and an arm portion of the body. In the first embodiment, the cloth portion 10 is formed having a shape of a blouson-type upper wear. Moreover, the cloth portion 10 also plays a role of guiding air generated by the air blowing means 30 and 30 along a surface of the body or an underwear in a space between the cloth portion 10 and the body or the underwear. That is, the cloth portion 10 plays a role of air guiding means as well as a role of clothes covering the body. In this embodiment, the "underwear" means clothes worn under the air-conditioning clothing 1.

Since the cloth portion 10 plays the role of the air guiding means as described above, as a material of the cloth portion 10, a material that can allow the air to flow smoothly in the space between the cloth portion 10 and the body or the underwear and also is a sheet-shaped material with less ventilation is used. In the first embodiment, as the material of the cloth portion 10, a woven cloth obtained by weaving yarns at a high density is used.

On a front part (front body) of the cloth portion 10, the opening/closing means 20 is provided. This opening/closing means 20 is for opening/closing the front part when the air-conditioning clothing 1 is to be worn. In the first embodiment, a fastener is used as the opening/closing means 20.

The air blowing means 30 and 30 take in the air from the outside and forcedly generate a flow of the air in the space between the cloth portion 10 and the body or the underwear. The two air blowing means 30 and 30 are detachably attached to a lower part on the right and left side parts of the cloth portion 10, respectively. The power supply means 40 supplies electric power to the air blowing means 30 and 30. The power supply means 40 and the two air blowing means 30 and 30 are connected to each other by a power supply cable 41.

On a hem portion of the cloth portion 10, the air-leakage preventing means 50 for hem is provided. This air-leakage preventing means 50 for hem prevents leakage of the air flowing in the space between the cloth portion 10 and the body or the underwear to the outside through the hem portion. For example, as the air-leakage preventing means 50 for hem, an elastic member such as flat rubber (band-shaped rubber) or the like which is placed in a hem portion of the cloth portion 10 can be used. As a result, the hem portion of the cloth portion 10 can be brought into close contact with the body, underwear or pants or the like and thus, leakage of the air to the outside through the hem portion can be reliably prevented.

In the first embodiment, the case in which the cloth portion 10 is formed having the shape of the blouson-type upper wear is described, but the cloth portion 10 can be formed having a shape of a shirt-type upper wear whose hem portion is put into the pants. In this case, placing the hem portion in the pants, that is, bringing the hem portion into close contact with the body by the pants becomes the air-leakage preventing means 50 for hem.

The air discharge portion (air discharge means for collar) 70 for collar discharges the air flowing in the space between the cloth portion 10 and the body or the underwear to the outside and is provided on the collar of the cloth portion 10. For example, by forming the collar of the cloth portion 10 having a shape such that the air can be discharged easily from between the collar and the neck, the air discharge portion 70 for collar is obtained. Moreover, by using a material with high ventilation for a portion corresponding to an upper part of the back and a portion corresponding to shoulders in the cloth portion 10, a function of assisting the air discharge portion. 70 for collar may be given to the portion. In this case, the portion can be regarded as a part of the air discharge portion 70 for collar. As described above, instead of use of the material with small ventilation for the entire cloth portion 10 or particularly for the entire portion corresponding to the trunk, the material with good ventilation may be used for the required portion in the cloth portion 10 from the viewpoint of improvement of the performances of the air-conditioning clothing 1.

The air-leakage preventing means 80 for lower sleeve edge is provided at the lower sleeve edge of the cloth portion 10. This air-leakage preventing means 80 for lower sleeve edge prevents leakage of the air flowing in the space between the cloth portion 10 and the body or the underwear to the outside through the lower sleeve edge. Specifically, the air-leakage preventing means 80 for lower sleeve edge is constituted by tightening the lower sleeve edge so that the lower sleeve edge of the cloth portion 10 is brought into close contact with the wrist.

The air discharge portion (air discharge means for sleeve) 90 for sleeve discharges the air flowing in the space between the cloth portion 10 and the body or the underwear to the outside similarly to the air discharge portion 70 for collar. This air discharge portion 90 for sleeve is provided at a predetermined portion in the vicinity of the lower sleeve edge of the cloth portion 10. Particularly in the first embodiment, a sheet-shaped one capable of discharging the air from the surface of the portion of the cloth portion 10 where it is provided to the outside is used for the air discharge portion 90 for sleeve. Specifically, as illustrated in FIG. 1, a plurality of circular opening holes 91 are formed at portions from the lower sleeve edge to the vicinity of an elbow portion of the cloth portion 10, and the portion of the cloth portion 10 having these opening holes 91 are made the air discharge portion 90 for sleeve. Here, a size/number of the opening holes 91 is determined such that the air in an amount substantially equal to the discharge amount of the air from the lower sleeve edge in the prior-art air-conditioning clothing can be discharged from the air discharge portion 90 for sleeve.

As described above in the first embodiment, the case in which the air discharge portion 90 for sleeve is a part of the cloth portion 10 having the plurality of opening holes 91 formed at the predetermined portion in the vicinity of the lower sleeve edge of the cloth portion 10 is considered, but in general, if the function capable of discharging the air from the surface of the portion to the outside can be given to the predetermined portion in the vicinity of the lower sleeve edge of the cloth portion 10, the air discharge portion 90 for sleeve may be constituted by any method. For example, the predetermined portion in the vicinity of the lower sleeve edge in the cloth portion 10 may be formed by a material having ventilation and the portion of the cloth portion 10 formed of the material with ventilation may be the air discharge portion 90 for sleeve. Here, as the material having ventilation, a cloth with high ventilation or a fine mesh-state material can be used.

Figure 2A:
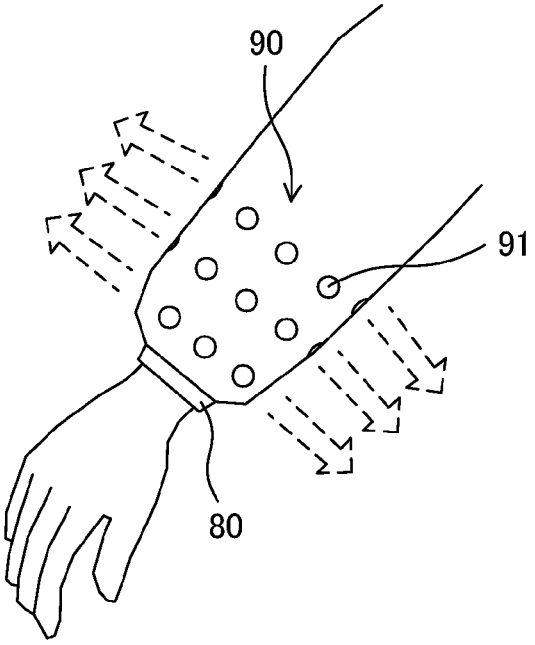
FIG. 2 are views for explaining a discharge direction of the air discharged from an air discharge portion for sleeve of the air-conditioning clothing of the first embodiment.
Figure 2B:
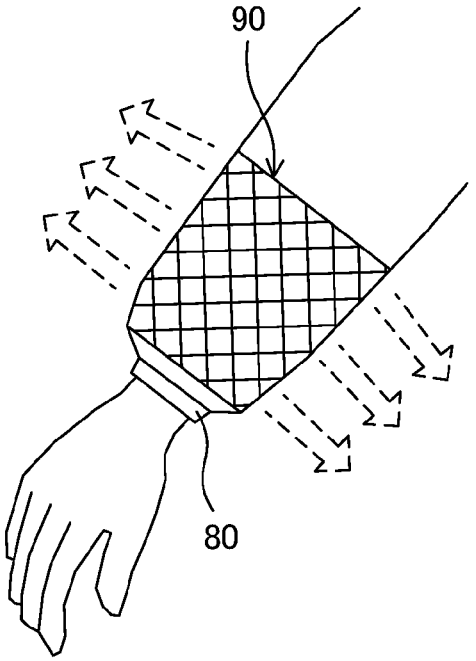

FIG. 2 are views for explaining the discharge direction of the air discharged from the air discharge portion 90 for sleeve of the air-conditioning clothing 1 of the first embodiment. Here, FIG. 2A illustrates the discharge direction of the air if the air discharge portion 90 for sleeve is the portion of the cloth portion 10 having the plurality of opening holes 91, while FIG. 2B illustrates the discharge direction of the air if the air discharge portion 90 for sleeve is the portion of the cloth portion 10 formed of the material having ventilation. The air discharge portion 90 for sleeve is the sheet-shaped one provided on the predetermined portion in the vicinity of the lower sleeve edge of the cloth portion 10 and thus, a large quantity of the air is not ejected from the air discharge portion 90 for sleeve toward the fingertip. Actually, if the air discharge portion 90 for sleeve is the portion of the cloth portion 10 having the plurality of opening holes 91, as illustrated in FIG. 2A, the discharge direction of the air in the opening holes 91 formed close to the lower sleeve edge is a direction substantially perpendicular to a surface of the cloth portion 10. In the discharge direction of the air in the opening holes 91 formed away from the lower sleeve edge, a component of the direction toward the fingertip gradually increases as it is separated away from the lower sleeve edge to a side of the elbow portion. Similarly, if the air discharge portion 90 for sleeve is the portion of the cloth portion 10 formed of the material having ventilation, too, as illustrated in FIG. 2B, the discharge direction of the air in the portion close to the lower sleeve edge is a direction substantially perpendicular to the surface of the portion, and in the discharge direction of the air in the portion away from the lower sleeve edge, a component of the direction toward the fingertip gradually increases as it is separated away from the lower sleeve edge to a side of the elbow portion. However, even if the discharge direction of the air discharged from the air discharge portion 90 for sleeve has the component in the direction toward the fingertip, the air is not ejected directly from the air discharge portion 90 for sleeve toward the fingertip.

In the air-conditioning clothing 1 of the first embodiment, when a switch (not shown) of the power supply means 40 is turned on, power is supplied to the two air blowing means 30 and 30 from the power supply means 40, and each of the two air blowing means 30 and 30 takes in the outside air into the cloth portion 10. At this time, by means of a pressure of the taken-in air, a space through which the air is made to flow is automatically formed between the cloth portion 10 and the body or the underwear. Then, the air taken in by the air blowing means 30 and 30 moves upward along the surface of the body or the underwear in the space between the cloth portion 10 and the body or the underwear. Then, a part of the air is discharged to the outside through the air discharge portion 70 for collar, while the other air flows in the space between the arm portion of the cloth portion 10 and the body or the underwear and is discharged to the outside through the air discharge portion 90 for sleeve. If the air-conditioning clothing 1 is used as a clothes for work, in order that the wearer can be sufficiently cooled, an amount of the air to be taken in by the two air blowing means 30 and 30 from the outside to the space between the cloth portion 10 and the body or the underwear needs to be at least 5 liters per second.

In the air-conditioning clothing of the first embodiment, the air-leakage preventing means for lower sleeve edge for preventing leakage of the air to the outside through the lower sleeve edge is provided on the lower sleeve edge of the cloth portion, and the sheet-shaped air discharge portion for sleeve for discharging the air from the surface of the portion to the outside is provided at the predetermined portion in the vicinity of the lower sleeve edge of the cloth portion and thus, the air is not ejected directly from the lower sleeve edge toward the fingertip. Thus, by using the air-conditioning clothing of the first embodiment, flame of welding is not disturbed when the welding work is performed, or documents and the like are not made to fly away when the work handling the documents or banknotes is performed, for example. Moreover, if the air-conditioning clothing of the first embodiment is used as the rainwear, when the hand is raised, the rainwater adhering to the hand does not enter inside from the lower sleeve edge. Furthermore, by providing the air discharge portion for sleeve in the vicinity of the lower sleeve edge of the cloth portion, the air taken into the cloth portion from the air blowing means flows also in the space between the arm portion of the cloth portion and the body or the underwear, and thus, substantially the whole portion of the body covered by the cloth portion can be cooled, and the body cooling performances are not lost.

Second Embodiment

Figure 3:
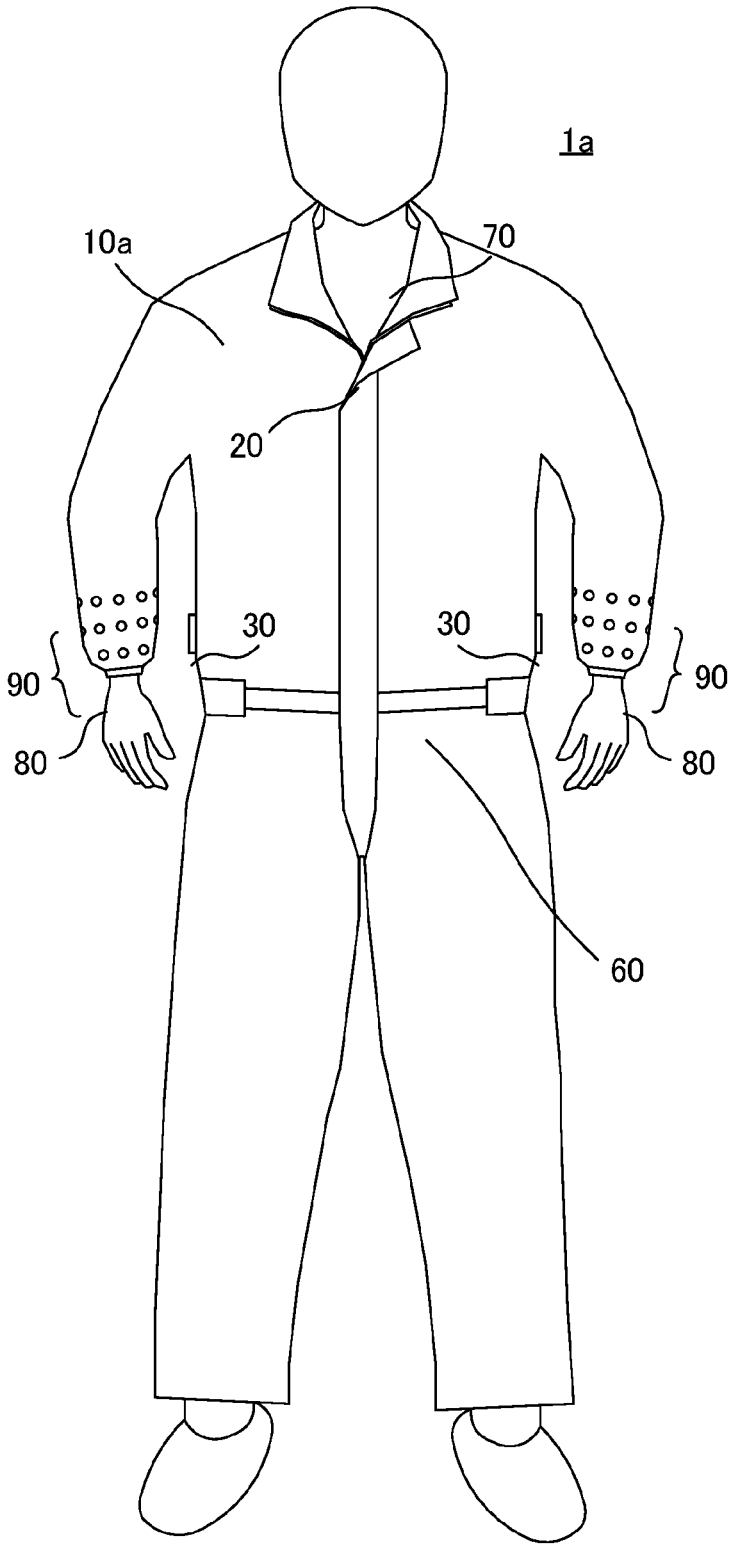
FIG. 3 is a schematic front view of an air-conditioning clothing which is a second embodiment of the present invention.

Subsequently, an air-conditioning clothing which is a second embodiment of the present invention will be described. FIG. 3 is a schematic front view of the air-conditioning clothing which is the second embodiment of the present invention. In the second embodiment, those having the same function as those in the first embodiment are given the same reference numerals, and detailed description will be omitted.

As illustrated in FIG. 3, the air-conditioning clothing 1*a* of the second embodiment includes a cloth portion 10*a*, the opening/closing means 20, the two air blowing means 30 and 30, the power supply means 40, flow-rate adjusting means 60, the air discharge portion 70 for collar, the air-leakage preventing means 80 for lower sleeve edge, and the sheet-shaped air discharge portion 90 for sleeve. Here, in FIG. 3, the power supply means 40 is omitted and not shown. The points that the air-conditioning clothing 1*a* of the second embodiment is different from the air-conditioning clothing 1 of the first embodiment are that the clothing portion 10*a* is formed having a shape of overalls and that the flow-rate adjusting means 60 is provided instead of the air-leakage preventing means for hem. The other constitutions are the same as those of the first embodiment.

In the case of the air-conditioning clothing 1*a* formed having the shape of overalls, the flow-rate adjusting means 60 is provided on a torso portion of the cloth portion 10*a*. This flow-rate adjusting means 60 adjusts a flow rate of air flowing out from an upper part to a lower part (pants) across the torso portion as a border in a space between the cloth portion 10*a* and the body or the underwear. In general, a belt is provided at a portion around the torso portion in overalls. In the second embodiment, as illustrated in FIG. 3, the belt is used as the flow-rate adjusting means 60. By changing a degree of tightening the body by the belt, the flow rate of the air flowing out from the upper part to the lower part can be easily adjusted. By adjusting by the flow-rate adjusting means 60 such that the air does not flow out from the upper part to the lower part, the amount of the air discharged to the outside from each of the air discharge portions 70 and 90 becomes substantially the same as that of the first embodiment.

Depending on the use purpose of the air-conditioning clothing 1*a*, there is no need to make the air flow to the lower part in some cases. In such a case, the air-leakage preventing means for preventing outflow of the air flowing in the space between the cloth portion 10*a* and the body or the underwear from the upper part to the lower part may be used as the flow-rate adjusting means 60. Specifically, this air-leakage preventing means is provided instead of the belt on the torso portion of the cloth portion 10*a*. For example, an elastic member such as flat rubber or the like put in the torso portion of the cloth portion 10*a* is used as the air-leakage preventing means. As a result, by bringing the torso portion of the cloth portion 10*a* into close contact with the body or the underwear, the air can be prevented from flowing to the lower part.

The air-conditioning clothing of the second embodiment has the action/effects substantially similar to those of the air-conditioning clothing of the first embodiment.

Third Embodiment

Figure 4A:
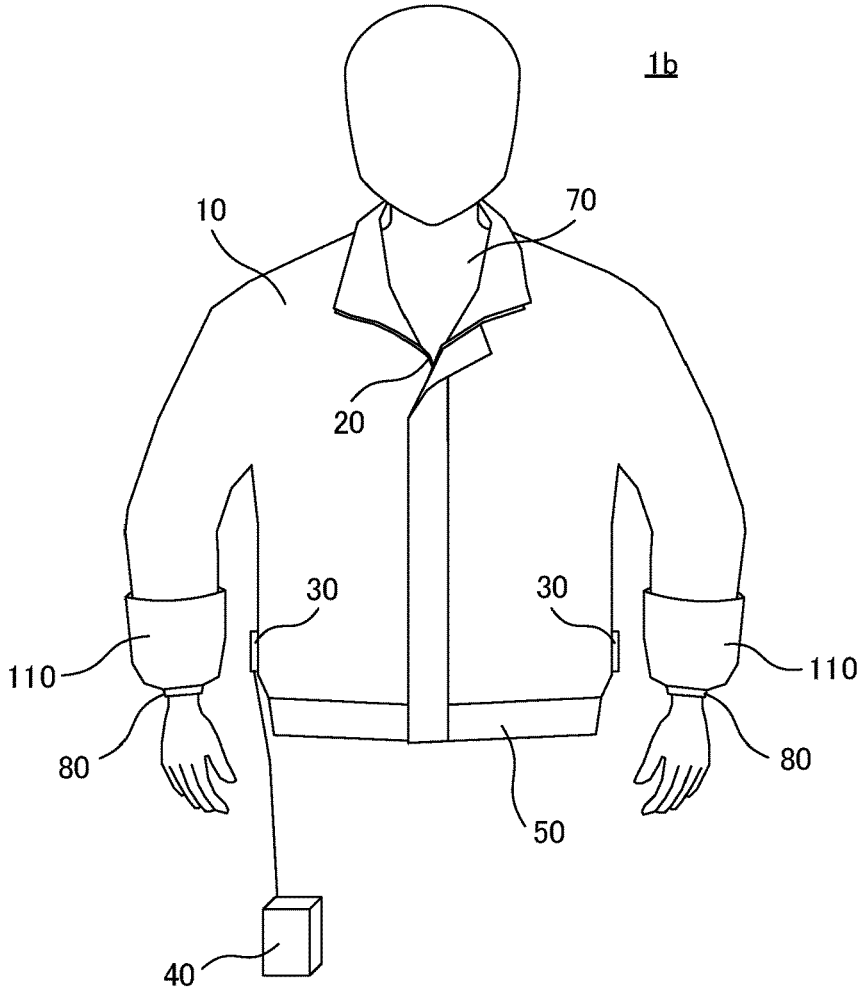
FIG. 4A is a schematic front view of an air-conditioning clothing which is a third embodiment of the present invention.
Figure 4B:
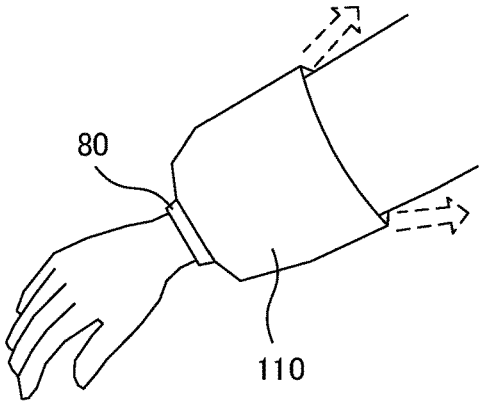
FIG. 4B is a view for explaining a discharge direction of the air discharged from the air discharge portion for sleeve of the air-conditioning clothing.
Figure 5:
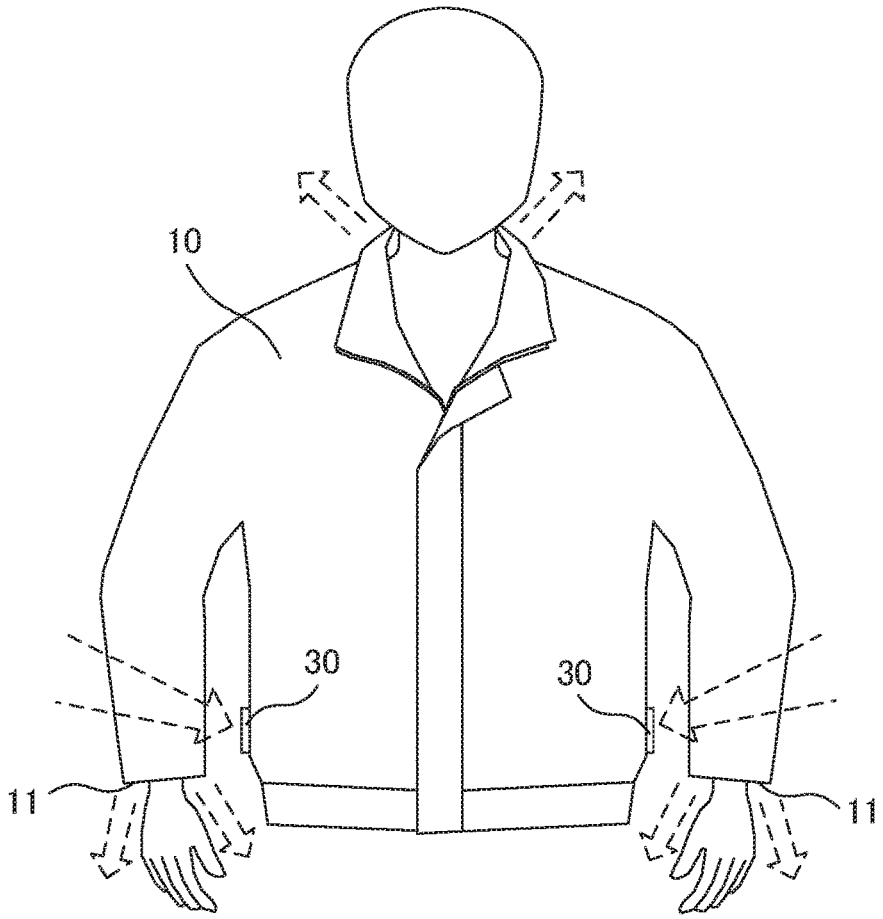
FIG. 5 is a schematic front view of a prior-art air-conditioning clothing.

Subsequently, an air-conditioning clothing which is a third embodiment of the present invention will be described. FIG. 4A is a schematic front view of the air-conditioning clothing which is the third embodiment of the present invention, and FIG. 4B is a view for explaining a discharge direction of the air discharged from the air discharge portion for sleeve of the air-conditioning clothing. In the third embodiment, those having the same function as those in the first embodiment are given the same reference numerals, and detailed description will be omitted.

As illustrated in FIG. 4A, the air-conditioning clothing 1*b* of the third embodiment includes the cloth portion 10, the opening/closing means 20, the two air blowing means 30 and 30, the power supply means 40, the air-leakage preventing means 50 for hem, the air discharge portion 70 for collar, the air-leakage preventing means 80 for lower sleeve edge, the sheet-shaped air discharge portion 90 for sleeve, and air guiding means 110. A point that the air-conditioning clothing 1*b* of the third embodiment is different from the air-conditioning clothing 1 of the first embodiment is that the air guiding means 110 is provided. The other constitutions are the same as those of the first embodiment.

The air guiding means 110 guides the air discharged from the air discharge portion 90 for sleeve so that the air flows to a side opposite to the lower sleeve edge and is provided on the sleeve of the cloth portion 10. Specifically, the air guiding means 110 is obtained, as illustrated in FIG. 4, by forming a sheet-shaped member with small ventilation cylindrically. In a state in which the entirety of the air discharge portion 90 for sleeve is covered by this cylindrical air guiding means 110, an end portion of the air guiding means 110 on a lower sleeve edge side is fixed to the cloth portion 10. That is, the end portion of the air guiding means 110 on the lower sleeve edge side is in a closed state, while the end portion of the air guiding means 110 on the side opposite to the lower sleeve edge is in an open state. Thus, the air discharged from the air discharge portion 90 for sleeve is guided by the air guiding means 110 to a direction opposite to the lower sleeve edge, and as illustrated in FIG. 4B, the air flows toward the shoulders from the open end portions of the air guiding means 110.

The air-conditioning clothing of the third embodiment has the action/effects substantially similar to those of the air-conditioning clothing of the first embodiment. Particularly in this air-conditioning clothing of the third embodiment, by providing the air guiding means for guiding the air discharged from the air discharge portion for sleeve so that it flows to the side opposite to the lower sleeve edge on the sleeve of the cloth portion, a direction of the flow of the air discharged from the air discharge portion for sleeve is regulated, and flowing of the air toward the fingertip can be reliably prevented. Thus, the air-conditioning clothing of the third embodiment can be used also when a fine work which should avoid outflow of weak wind from the vicinity of the wrist is performed.

The present invention is not limited to each of the aforementioned embodiments but is capable of various variations within a range of the gist thereof.

For example, in each of the aforementioned embodiments, the case in which two air blowing means are attached to the cloth portion is described, but one or three or more air blowing means may be attached to the cloth portion.

Moreover, in each of the aforementioned embodiments, the case in which the air discharge portion for sleeve is a portion of the cloth portion having the plurality of circular opening holes is described, but the air discharge portion for sleeve may be a portion of the cloth portion having a plurality of slit-shaped opening holes, for example.

INDUSTRIAL APPLICABILITY

As described above, in the air-conditioning clothing of the present invention, by providing the air-leakage preventing means for lower sleeve edge for preventing leakage of air to the outside from the lower sleeve edge on the lower sleeve edge of the cloth portion and by providing the sheet-shaped air discharge portion for sleeve for discharging the air to the outside at the predetermined portion in the vicinity of the lower sleeve edge of the cloth portion, the air is not ejected directly from the lower sleeve edge toward the fingertip. Moreover, by providing the air discharge portion for sleeve in the vicinity of the lower sleeve edge of the cloth portion, since the air taken into the cloth portion by the air blowing means flows also in the space between the arm portion of the cloth portion and the body or the underwear, the substantially the whole portion of the body covered by the air-conditioning clothing can be cooled, and the body cooling performances are not lost. Therefore, the air-conditioning clothing of the present invention is preferably used when the work susceptible to the wind such as the welding work, the desk work, the food processing work and the like is to be performed.

DESCRIPTION OF THE REFERENCE NUMERAL

1, 1*a*, 1*b* air-conditioning clothing
10, 10*a* cloth portion
20 opening/closing means
30 air blowing means
40 power supply means
41 power supply cable
50 air-leakage preventing means for hem
70 air discharge portion for collar (air discharge means for collar)
60 flow-rate adjusting means
80 air-leakage preventing means for lower sleeve edge
90 air discharge portion for sleeve (air discharge means for sleeve)
91 opening hole
110 air guiding means

The invention claimed is:

1. An air-conditioning clothing, comprising:

a cloth portion covering at least an upper part and an arm portion of a body and guiding air in a space between the cloth portion and the body or an underwear along a surface of the body or the underwear;

one or a plurality of air blowing fans attached to a predetermined spot of the cloth portion wherein the one or the plurality of air blowing fans take in air from an outside and for forcedly generate a flow of the air in the space between the cloth portion and the body or the underwear;

a power supply wherein the power supply supplies power to the one or the plurality of air blowing fans;

an air discharge portion for collar provided on a collar of the cloth portion wherein the air discharge portion for collar discharges the air flowing in the space between the cloth portion and the body or the underwear to the outside;

wherein a lower sleeve edge of the cloth portion is configured to be brought into contact with a wrist of the body and prevent leakage of the air flowing in the space between the cloth portion and the body or the underwear to the outside through the lower sleeve edge;

a sheet-shaped air discharge portion for sleeve provided at a predetermined portion in a vicinity of the lower sleeve edge of the cloth portion wherein the sheet-shaped air discharge portion for sleeve discharges the air flowing in the space between the cloth portion and the body or the underwear to the outside, wherein:

a cylindrically shaped air guiding cover is disposed on a sleeve of the cloth portion wherein the air guiding cover covers the air discharge portion for sleeve and guides the air discharged from the air discharge portion for sleeve to a side opposite to the lower sleeve edge;

the air discharge portion for sleeve is a portion of the cloth portion having a plurality of opening holes or a portion of the cloth portion formed by a material having ventilation; and a first end portion of the air guiding cover on a lower sleeve edge side is fixed to a predetermined portion of the cloth portion in a vicinity of the lower sleeve edge so as to be in a closed state, and a second end portion of the air guiding cover on a side opposite to the lower sleeve edge side is in an open position.

2. The air-conditioning clothing according to claim 1, wherein:

the cloth portion is formed having a shape of a blouson; and a band-shaped elastic member wherein the band-shaped elastic member prevents leakage of the air flowing in the space between the cloth portion and the body or the underwear from a hem portion of the cloth portion to the outside and is provided on the hem portion of the cloth portion so that the hem portion of the cloth portion is brought into contact with the body, the underwear or pants.

3. The air-conditioning clothing according to claim 1, wherein:

the cloth portion is formed having a shape of overalls; and a flow-rate adjuster wherein the flow-rate adjuster adjusts a flow rate of the air flowing out from an upper part to a lower part across a torso portion of the cloth portion as a border in the space between the cloth portion and the body or the underwear and is provided on the torso portion of the cloth portion.

4. The air-conditioning clothing according to claim 1, wherein:

an amount of the air taken in by the one or the plurality of air blowing fans into the space between the cloth portion and the body or the underwear from the outside is at least 5 liters per second.

* * * * *